US006019497A

United States Patent [19]

Ingerttilä et al.

[11] Patent Number: 6,019,497

[45] **Date of Patent: *Feb. 1, 2000**

[54] MIXING

[75] Inventors: Kauko Tapio Ingerttilä; VäinöViljo Heikki Hintikka; Raimo Tapio Tahvanainen; Veli Markku Klemetti; Pekka Pärttyli Mörsky; Veli Tapio Knuutinen, all of Outokumpu, Finland

[73] Assignee: Valtion Teknillinen Tutkimuskeskus, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,711

[22] Filed: Mar. 4, 1998

[30] Foreign Application Priority Data

Apr. 20, 1995 [FI] Finland ..... 951181 U
Apr. 19, 1996 [FI] Finland ..... PCT/FI96/00215

[51] Int. Cl.[7] ..... B01F 15/02; B01F 5/08

[52] U.S. Cl. ..... 366/136; 366/165.2

[58] Field of Search ..... 366/165.1, 165.4, 366/165.2, 101, 136, 137; 261/79.1, 79.2, 28, 35, DIG. 16, DIG. 75; 99/302 C, 287; 239/7, 8, 311, 318

[56] References Cited

U.S. PATENT DOCUMENTS

| | | | |
|---|---|---|---|
| 3,131,037 | 4/1964 | Backstrom et al. | 261/79.2 |
| 3,775,314 | 11/1973 | Beitzel et al. | 261/79.2 |
| 3,885,918 | 5/1975 | Isahaya | 261/79.2 |
| 4,014,961 | 3/1977 | Popov | 261/DIG. 75 |
| 4,215,081 | 7/1980 | Brooks | 366/165.1 |
| 4,398,827 | 8/1983 | Dietrich | 366/165.4 |
| 4,415,275 | 11/1983 | Dietrich | 366/165.1 |
| 4,688,945 | 8/1987 | Brazelton et al. | 366/165.1 |
| 4,741,624 | 5/1988 | Barroyer | 366/165.1 |
| 5,426,137 | 6/1995 | Allen | 366/165.2 |
| 5,705,060 | 1/1998 | Robberts | 366/165.1 |

FOREIGN PATENT DOCUMENTS

| | | | |
|---|---|---|---|
| 487199 | 6/1955 | Italy | 366/165.1 |
| 38028 | 2/1985 | Japan | 366/165.1 |
| 685806 | 9/1979 | U.S.S.R. | 366/165.1 |
| 716594 | 10/1954 | United Kingdom | 366/165.1 |
| 1115288 | 5/1968 | United Kingdom . | |

*Primary Examiner*—Tony G. Soohoo
*Attorney, Agent, or Firm*—Medlen & Carroll, LLP

[57] ABSTRACT

The invention relates to the mixing of a gas with a liquid. The apparatus has a mixing space (5) between two surfaces of revolution one inside the other, into which space the liquid and the gas are fed tangentially so that the mixture comes into a rotary motion into the space. An inner mantle (2) with a conical intermediate section a forms a cross-sectional annular chamber which is smaller than the cross-section of the upper section of the annular chamber section (5). The invention can be used for example, in froth flotation processes, in dissolving processes, or in the aeration of waters.

21 Claims, 2 Drawing Sheets

A - A

MIXING

FIELD OF TECHNOLOGY

The invention pertains to the field of process technology and relates to an apparatus and method for mixing a gas with a liquid. The invention can be used, for example, in ore dressing, in dissolving processes, and in the aeration of water.

BACKGROUND

For the mixing of a gas with a liquid there are used, for example, perforated nozzles through the perforations of which the gas is directed under pressure into the liquid.

FIG. 5 in publication GB-1115288 also shows a mixing apparatus in which a liquid and a gas are fed tangentially into a space between two cylindrical surfaces, the liquid into the upper section and the gas into a lower point, under an annular skirt. The mixture is withdrawn upwards via a connection in the center. In this apparatus, the cross-sectional area of the opening which leads out of the annular mixing space is greater than the area of the feed connections.

DESCRIPTION OF THE INVENTION

GENERAL DESCRIPTION

A mixing apparatus according to claim 1 has now been invented. Certain preferred embodiments of the invention are stated in the other claims.

The most essential idea of the invention is that the liquid and the gas to be mixed with it are fed tangentially into the space between two surfaces of revolution so that the mixture comes into a rotary motion in the space, and that the mixture leaves the mixing space via a nozzle opening when a cross-section of area smaller than the cross-sectional area of the feed connections. During the rotary motion, the gas, in the form of small bubbles, will mix with the liquid, and dissolve in the liquid. Preferably the pressure in the mixing space is higher before nozzle opening after, so that after mixing the liquid will be supersaturated. In this case, dissolved gas will separate from the solution and micro-sized gas bubbles will form.

The nozzle opening is preferably at one end of the mixing space.

In one embodiment of the invention, a plurality of feed connections is contemplated. These connections may be placed at desired locations either on the outer or on the inner periphery of the mixing space.

The shape of the reactor may vary, which can be determined according to the use and the application.

The invention can be used, for example, in froth flotation of ores for the formation of bubbles, and in the maintenance of a slurry suspension. The invention is also highly applicable also to the aeration of waste water tanks and watercourses. Various dissolving processes requiring the addition of a gas are also typical areas of use for the invention.

DESCRIPTION OF THE DRAWINGS

In the drawings of the specification.

DETAILED DESCRIPTION OF CERTAIN EMBODIMENTS

Figure 2:
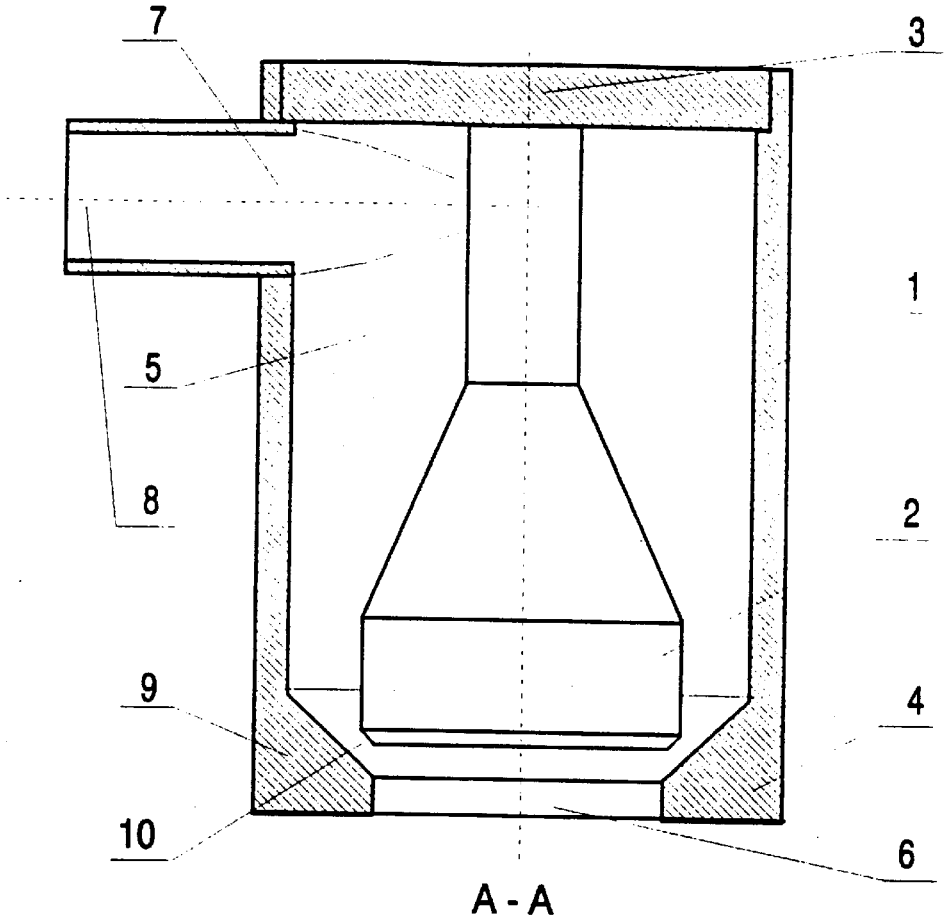
FIG. 2 shows a side view of the same apparatus, through section A—A.
Figure 1:
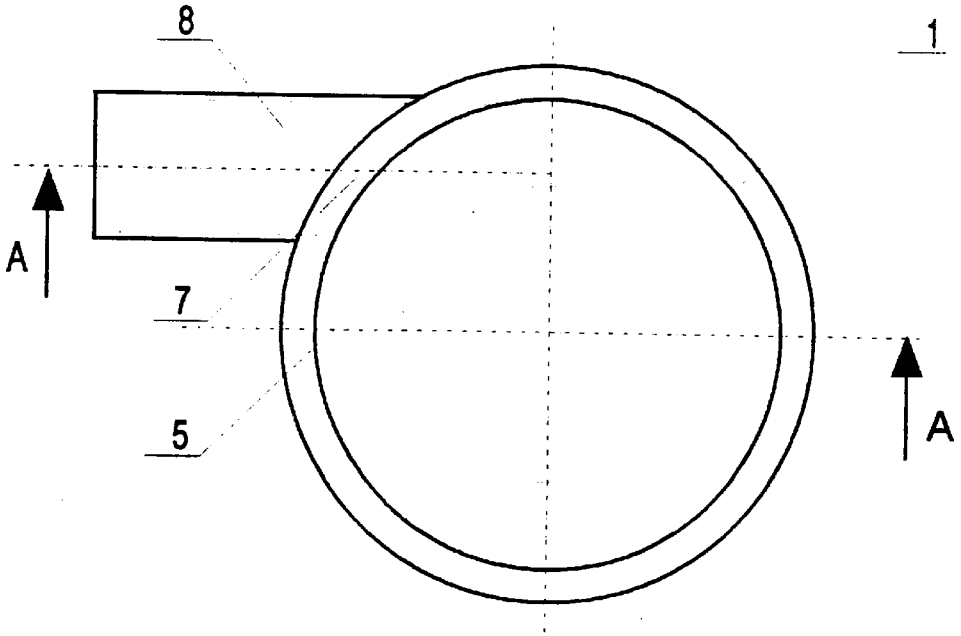
FIG. 1 shows a top view of a gas-mixing reactor according to the invention.

The reactor shown in FIGS. 1 and 2 has a cylindrical outer mantle 1 and, inside it parallelly, a narrower inner mantle 2; which is attached to the closed upper end 3 of the reactor but detached from the reactor bottom 4. Between the mantles is an annular chamber 5. There is an opening 6 in the center of the reactor bottom.

The inner mantle 2 has here a narrower cylindrical upper section and a broader cylindrical lower section linked thereto via a conical intermediate section. Thus the cross-sectional area of the upper section of the reactor is greater.

At the upper end of the annular chamber 5 the outer mantle 1 has a feed inlet 7 with a tangential feed pipe 8. A liquid material and a gas are fed under pressure via the feed pipe into the annular chamber in such a manner that they come into a rotary motion in the annular chamber. Gas is incorporated and dissolved into the liquid as bubbles. Any gas not mixed with the liquid separates as a ring on the surface of the inner mantle. From this, gas becomes further mixed into the liquid.

At the bottom 4 of the reactor, in its corner, there is an annular limiting ring 9 in such a manner that, between the lower end of the inner mantle 2 and the limiting ring, there is formed an annular nozzle opening 10 having a flow cross section smaller than the cross section of the upstream part of the annular chamber.

The reactor is operated at a feed pressure such that, when the mixture flows to the nozzle opening 10 and its pressure decreases, the mixture is supersaturated with respect to gas, in which case dissolved gas separates out, forming micro-sized bubbles. Such micro-bubbles adhere to the surfaces of larger bubbles in the mixture. These larger bubbles serve as efficient carrier bubbles. Owing to the micro-bubbles, the total surface area of the bubbles is very large. The size, number and mutual proportions of the bubbles can be adjusted by adjusting the feed ratio, feeding pressure, or the surface area of the nozzle opening.

The upper end of the inner mantle 2 may be open, in which case bubbles will leave via that route. Such an apparatus would be especially suited for the processing of a slurry, in which case heavier slurry will leave via opening 6.

Figure 3:
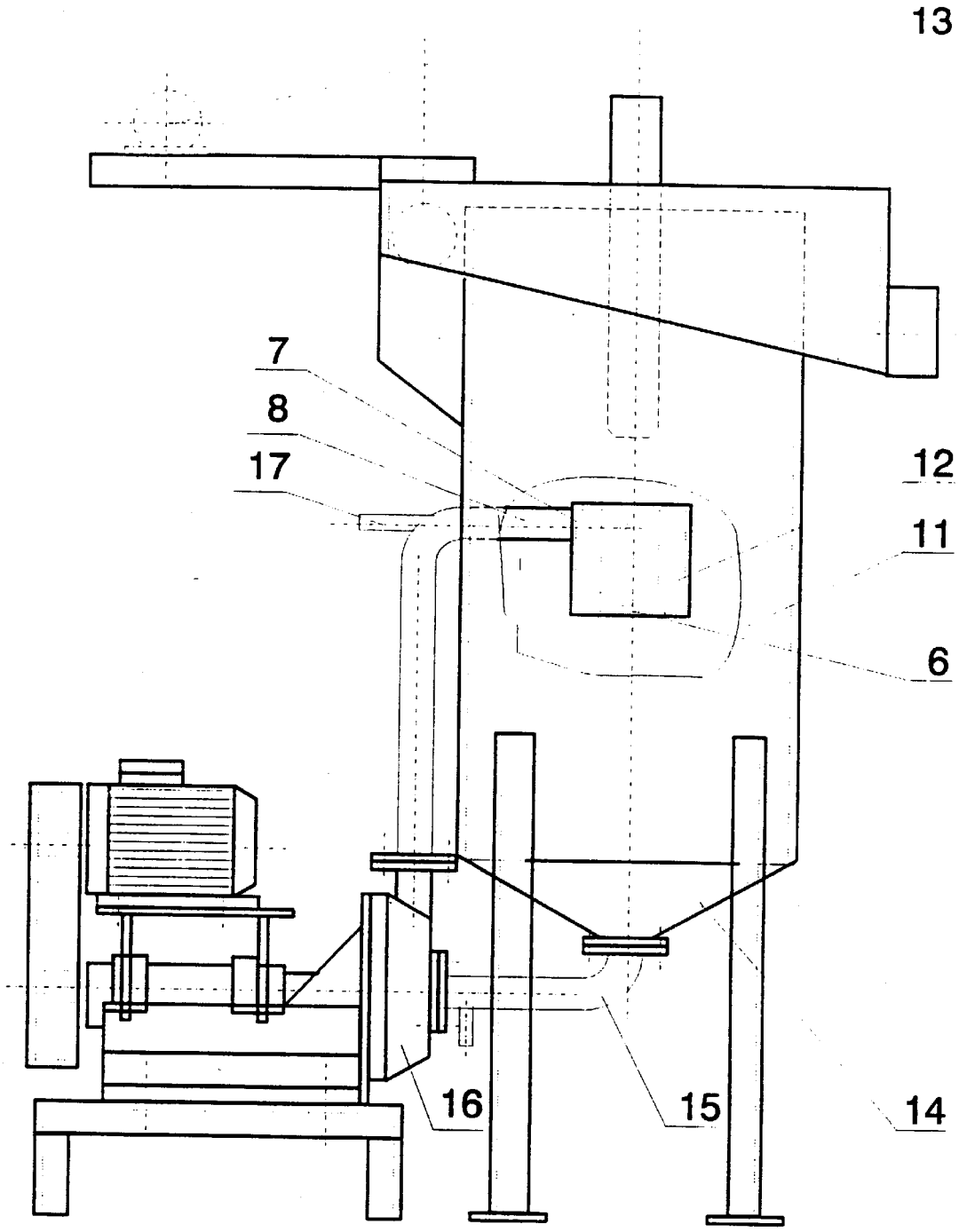
FIG. 3 shows a froth flotation apparatus in which mixing according to the invention is used.

The mineral slurry froth-flotation apparatus according to FIG. 3 has a container 11 and, inside it, a gas-mixing reactor 12 of the type described above. Slurry is introduced into the container from the upper end via a feed pipe 13. Connected to the lowest point of the reactor bottom 14 is a recycling pipe 15, through which slurry which has settled on the bottom is directed by means of a pump 16, leading to the feed pipe 8 of the mixing reactor. Air via connection 17 is also fed into the feed pipe. The overpressure prevailing in the feed pipe is, for example, 1-2 bar. In the reactor, air becomes mixed with the slurry and partly dissolved therein. A large quantity of micro-bubbles are formed in the mixture emerging from the reactor. Hydrophobic mineral particles from the slurry adhere to the surfaces of the bubbles. The bubbles rise to the surface of the container as a froth, which is recovered for further treatment. The process is designed such that the bubbles will have time to separate from the slurry as completely as possible before the slurry flows into the recycling pipe.

We claim:

1. An apparatus for mixing a gas and a liquid, comprising:

i) a mixing chamber for mixing gas and liquid, and wherein said mixing chamber has a mixing space between an outer mantle and an inner mantle, wherein said inner mantle has a narrower upper section and a broader lower section, and a conical intermediate section connecting said upper and lower sections;

ii) at least one feed connection attached to said mixing chamber for tangentially feeding gas and liquid into said mixing chamber; and iii) a nozzle opening attached to said mixing space for withdrawing a mixture of gas and liquid from said mixing chamber, wherein the cross-sectional area of said nozzle opening is smaller than the cross-sectional area of said at least one feed connection.

2. The apparatus according to claim 1, wherein the cross-sectional area of said mixing chamber at a point before said nozzle opening is larger than the cross-sectional area of said nozzle opening.

3. The apparatus according to claim 1, wherein said nozzle opening is at one end of said mixing space.

4. The apparatus according to claim 1, wherein said nozzle opening is annular.

5. The apparatus according to claim 1, wherein said at least one feed connection is attached to said outer mantle of said mixing chamber.

6. The apparatus according to claim 1, wherein said outer mantle has a closed upper end and a bottom end, wherein said narrower inner mantle is attached to said closed upper region of said outer mantle, and wherein said narrower inner mantle is detached from said bottom end of said outer mantle.

7. The apparatus according to claim 6, wherein said bottom end of said outer mantle has an opening in the center.

8. The apparatus according to claim 1, further comprising a limiting ring, and wherein said nozzle opening is in between said limiting ring and said lower section of said inner mantle.

9. The apparatus according to claim 8, wherein said limiting ring is annular.

10. A method for froth-floatation, comprising the step of mixing a slurry and air into the apparatus of claim 1 under conditions such that microbubbles are formed.

11. A method for mixing a gas and a liquid, comprising the steps of:

a) providing:

i) a gas;

ii) a liquid; and iii) an apparatus for mixing said gas and said liquid, wherein said apparatus comprises:

(a) a mixing chamber having a mixing space between two surfaces of revolution, one inside the other;

(b) at least one feed connection attached to said mixing chamber for tangentially feeding said gas and said liquid into said chamber; and (c) a nozzle opening attached to said mixing space for withdrawing a mixture of gas and liquid from said mixing chamber, wherein the cross-sectional area of said nozzle opening is smaller than the cross-sectional area of said at least one feed connection; and b) tangentially feeding said gas and said liquid into said mixing chamber under conditions such that said liquid and said gas comes into a rotary motion around said mixing space to provide a gas and liquid mixture.

12. The method according to claim 11, further comprising the step of withdrawing said mixture as a continuous stream from said mixing chamber through said nozzle opening.

13. The method according to claim 11, wherein said feeding of said gas and said liquid occurs under pressure.

14. The method according to claim 11, wherein said gas is air.

15. The method according to claim 11, wherein said liquid is water.

16. The method according to claim 11, wherein said gas is air and wherein said liquid is water.

17. The method according to claim 11, wherein said liquid is a slurry.

18. The method according to claim 11, wherein said gas is air and said liquid is a slurry.

19. The method according to claim 18, further comprising the steps of:

c) mixing said slurry and said air such that microbubbles are formed and d) rising said microbubbles as a froth.

20. The method according to claim 19, further comprising the step of recycling said slurry.

21. The method of claim 11, wherein said liquid in said mixture is supersaturated with said gas.

* * * * *